US008375483B2

(12) United States Patent
Ray et al.

(10) Patent No.: US 8,375,483 B2
(45) Date of Patent: Feb. 19, 2013

(54) DAYBEDS AND METHODS FOR CONVERTING DAYBEDS

(75) Inventors: Steven R. Ray, Benicia, CA (US); Howard Porter, Kuala Lumpur (MY); Joel Grossman, Selangor (MY)

(73) Assignee: Night and Day Furniture LLC, Vancouver, WA (US)

( * ) Notice: Subject to any disclaimer, the term of this patent is extended or adjusted under 35 U.S.C. 154(b) by 179 days.

(21) Appl. No.: 11/878,831

(22) Filed: Jul. 27, 2007

(65) Prior Publication Data

US 2009/0025141 A1 Jan. 29, 2009

(51) Int. Cl.
*A47C 17/04* (2006.01)

(52) U.S. Cl. ..... 5/18.1; 5/28; 5/30; 5/12.1

(58) Field of Classification Search ..... 5/12.1, 5/28, 14, 17, 30, 18.1, 181, 185, 58, 59.1, 5/308

See application file for complete search history.

(56) References Cited

U.S. PATENT DOCUMENTS

| | | | | | |
|---|---|---|---|---|---|
| 523,372 | A | * | 7/1894 | Phillips | 5/30 |
| 1,346,532 | A | * | 7/1920 | Drummond | 74/334 |
| 1,448,127 | A | * | 3/1923 | Konrad | 5/31 |
| 2,852,787 | A | * | 9/1958 | Forest | 5/2.1 |
| 5,038,422 | A | * | 8/1991 | Messina | 5/21 |
| 6,161,231 | A | * | 12/2000 | Kraft et al. | 5/18.1 |

* cited by examiner

*Primary Examiner* — William Kelleher
(74) *Attorney, Agent, or Firm* — Harness, Dickey & Pierce, P.L.C.

(57) ABSTRACT

A daybed is disclosed that is convertible between a sitting configuration suitable for use, for example, as a sofa, and a lying configuration suitable for use, for example, as a bed. The daybed generally comprises a bed platform, a back panel connected to the bed platform, a mattress positioned at least partly on the bed platform, and a support member movable relative to the bed platform and back panel for use in at least partly helping convert the daybed. For example, in example embodiments the support member includes a storage container that may be positioned at least partly under the bed platform when the daybed is in the sitting configuration. And the storage container may be moved forward of the bed platform when the daybed is converted to the lying configuration so that at least part of the mattress may be also positioned on the storage container.

21 Claims, 11 Drawing Sheets

DAYBEDS AND METHODS FOR CONVERTING DAYBEDS

FIELD

The present disclosure relates generally to daybeds, and more particularly to daybeds having one or more movable support members for use in converting the daybeds between, for example, sitting configurations and lying configurations. The present disclosure also relates to methods for performing daybed conversions.

BACKGROUND

The statements in this section merely provide background information related to the present disclosure and may not constitute prior art.

Often, furniture capable of more than one function is used in environments (e.g., residential, commercial, etc.) where space is limited. For example, daybeds may be used in such environments as sitting furniture (e.g., couches, sofas, etc.) and lying furniture (e.g., beds, etc.). In these environments, daybeds may make more efficient use of the limited space and may relieve the need for additional furniture.

SUMMARY

According to various aspects of the present disclosure, example embodiments are provided of daybeds and support members for use with the daybeds.

In example embodiments, a daybed is convertible between a first configuration suitable for use, for example, as a sofa, and a second configuration suitable for use, for example, as a bed. The daybed generally comprises a frame, a mattress positioned at least partly on the frame, and a support member movable relative to the frame. The mattress is positioned at least partly on the support member when the daybed is in the second configuration.

In another example embodiment, a support member may be used with a daybed convertible between a first configuration suitable for use, for example, as a sofa, and a second configuration suitable for use, for example, as a bed. The support member generally comprises a support surface configured for orientation in a generally common plane with a corresponding support surface of a bed platform of the daybed when the daybed is in the second configuration.

Other aspects of the present disclosure relate to methods for converting daybeds between first configurations suitable for use, for example, as sofas and second configurations suitable for use, for example, as beds. For example in example embodiments, a method generally comprises converting the daybed from the first configuration to the second configuration. This generally includes moving a support member relative to the daybed such that a support surface of the support member is oriented in a generally common plane with a support surface of a bed platform of the daybed, and positioning a mattress over at least part of the support surface of the bed platform and over at least part of the support surface of the support member.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DESCRIPTION

Figure 1:
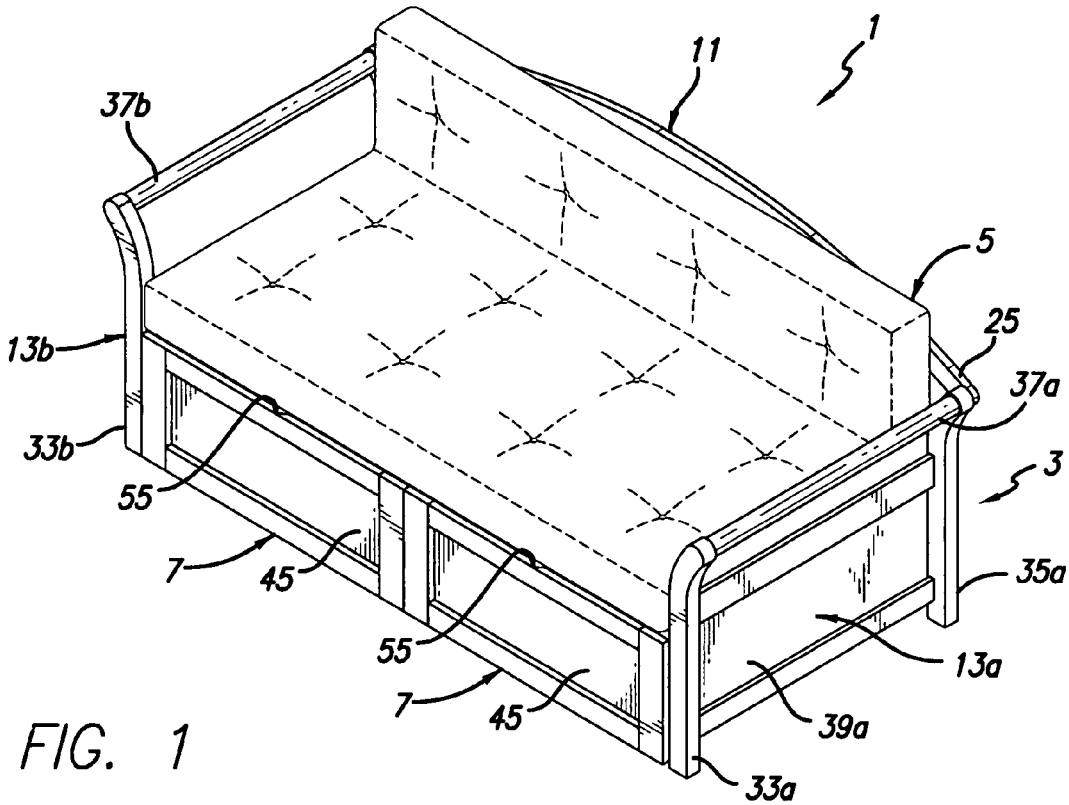
FIG. 1 is a perspective view of an example embodiment of a daybed with the daybed in a sitting configuration.

The following description is merely example in nature and is not intended to limit the present disclosure, application, or uses. It should be understood that throughout the drawings, corresponding reference numerals indicate like or corresponding parts and features.

Example embodiments will now be described more fully with reference to the accompanying drawings. Example embodiments may, however, be embodied in many different forms and should not be construed as being limited to the example embodiments set forth herein. Rather, these example embodiments are provided so that this disclosure will be thorough, and will fully convey the concept of the invention to those skilled in the art.

With reference now to the drawings, FIGS. 1-8 illustrate an example embodiment of a daybed generally at reference numeral 1. The example daybed 1 is convertible between a first sitting configuration (e.g., FIGS. 1 and 2) suitable for use, for example, as a sofa, couch, etc., and a second lying configuration (e.g., FIGS. 3 and 4) suitable for use, for example, as a bed, etc. As shown in FIG. 1, the daybed 1 generally may include a frame 3, a mattress 5 positioned at least partly on the frame 3, and two storage containers 7 (broadly, "support members"). As will be described in more detail hereinafter, the storage containers 7 are moveable relative to the frame 3 for use in at least partly helping convert the daybed 1 between the sitting configuration and lying configuration. For example, the containers 7 may be positioned generally under the frame 3 when the daybed 1 is in the sitting configuration. And the containers 7 may be moved forward of the frame 3 when the daybed 1 is converted to the lying configuration so that at least part of the mattress 5 may be positioned and/or supported on/over the containers. In other example embodiments, daybeds may include more than or fewer than two storage containers.

Figure 2:
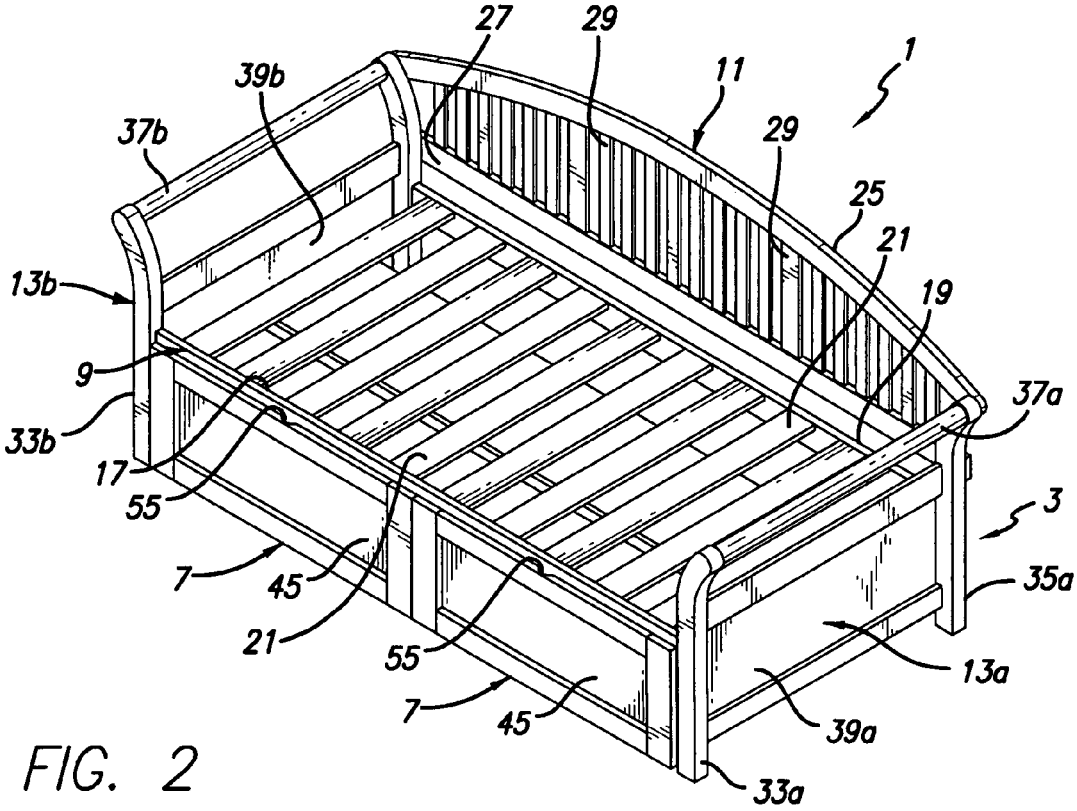
FIG. 2 is a perspective view similar to FIG. 1 with a mattress of the daybed removed.

As shown in FIG. 2, the illustrated frame 3 generally may include a bed platform 9, a back panel 11, and two arm panels 13*a*, 13*b* rigidly connecting the bed platform 9 and back panel 11. The back panel 11 may be viewed as connected to the bed platform 9 through the arm panels 13*a*, 13*b*. However, it is contemplated that the back panel 11 may connect directly to the bed platform 9 within the scope of the present disclosure. The assembled frame 3 may be constructed from wood, metal, combinations thereof, etc. within the scope of the present disclosure.

The bed platform 9 may include forward and rearward opposing border rails 17, 19 connecting multiple slats 21 therebetween. The slats 21 may be connected to the border rails 17, 19 by suitable fasteners, connectors, epoxy, etc. within the scope of the present disclosure. The border rails 17, 19 generally define forward and rearward edge-margins of the bed platform 9 and extend generally parallel to each other in a lengthwise direction of the daybed 1. The slats 21 each have similar lengths and extend in a generally parallel orientation between the border rails 17, 19, with each slat 21 spaced about a uniform distance from an adjacent slat 21. The slats 21 generally define a support surface of the bed platform 9 on/over which at least part of the mattress 5 may be positioned and/or supported (e.g., FIG. 1, etc.). In the illustrated embodiment, the border rails 17, 19 and slats 21 define a generally rectangular support surface. However, in other example embodiments, border rails and slats may define support surfaces having any other shape desired (e.g., square, oval, etc.).

The back panel 11 may include upper and lower border rails 25, 27 also connecting multiple slats 29 therebetween. The slats 29 may be connected to the border rails 25, 27 by suitable fasteners, connectors, epoxy, etc. within the scope of the present disclosure. The border rails 25, 27 extend in a generally lengthwise direction of the daybed 1. The upper rail 25 is generally arcuate in shape and may be spaced apart from the lower rail 27 by the slats 29. The slats 29 extend in a generally parallel orientation between the border rails 25, 27, with each slat 29 spaced about a uniform distance from an adjacent slat 29. The slats 29 generally define a support surface of the back panel 11 on/against which at least part of the mattress 5 may be positioned and/or supported (e.g., FIG. 1, etc.) when, for example, the daybed 1 is in the first configuration. In the illustrated embodiment, the border rails 25, 27 and slats 29 define a support surface having an arcuate upper edge. However, in other example embodiments border rails and slats may define support surfaces having any other shape desired (e.g., rectangular, square, oval, etc.).

With continued reference to FIG. 2, the arm panels 13*a*, 13*b* connecting the bed platform 9 and back panel 11 extend in a generally widthwise direction of the daybed 1, generally perpendicular to the bed platform 9 and back panel 11. The arm panels 13*a*, 13*b* each include pairs of legs 33*a*, 35*a* and 33*b*, 35*b*, respectively, that extend downwardly from armrests 37*a*, 37*b* to the floor. The legs 33*a*, 35*a* and 33*b*, 35*b* of each armrest 37*a*, 37*b* are spaced apart in the widthwise direction of the daybed 1 for supporting the bed platform 9 and back panel 11 above the floor. The arm panels 13*a*, 13*b* also each include side members 39*a*, 39*b* extending widthwise between the legs 33*a*, 35*a* and 33*b*, 35*b* for providing additional stability and/or support to the arm panels 13*a*, 13*b* and/or frame 3.

The bed platform 9 and back panel 11 connect to the arm panels 13*a*, 13*b* generally between the arm panels and generally perpendicular to each using suitable fasteners, connectors, epoxy, etc. The forward and rearward border rails 17, 19 of the bed platform 9 connect to forward and rearward legs 33*a*, 35*a*, 33*b*, 35*b* of the arm panels 13*a*, 13*b*, and the upper and lower border rails 25, 27 of the back panel 11 both connect to rearward legs 35*a*, 35*b* of the arm panels 13*a*, 13*b*. The bed platform 9 connects to the arm panels 13*a*, 13*b* a distance above the floor such that space may be provided between the bed platform 9 and floor. As will be described, the storage containers 7 may be positioned within this space under the frame 3 (and under the bed platform 9) when the daybed 1 is in the first configuration.

The daybed mattress 5 may include any suitable mattress type, size, etc. for use in sitting, lying, etc. on the daybed 1. For example, in the illustrated embodiment the mattress 5 may include a full size futon mattress. When the daybed 1 is in the sitting configuration (e.g., FIG. 1, etc.), the futon mattress 5 is capable of positioning substantially on/over the bed platform 9 of the daybed 1 as well as on/against the back panel 11. The futon mattress 5 may be at least partly formable to the configuration of the bed platform 9 and back panel 11 such that the mattress 5 folds at about where the back panel 11 and bed platform 9 connect. The futon mattress 5 may also be movable relative to the bed platform 9 and back panel 11 of the daybed 1. So when the daybed 1 is converted to the lying configuration (e.g., FIG. 3, etc.), the futon mattress 5 may be capable of positioning substantially on/over the bed platform 9 and storage containers 7 of the daybed 1 in a generally flat orientation. The mattress 5 may directly contact the bed platform 9 and/or back panel 11 and/or storage containers 9, or one or more intervening component may be included therebetween (e.g., pads, sheets, liner, supports, etc.). In other example embodiments, daybeds may include mattresses other than futon mattresses. In still other example embodiments, daybeds may include mattresses that do not readily fold and/or do not rest against back panels of the daybeds.

Figure 5:
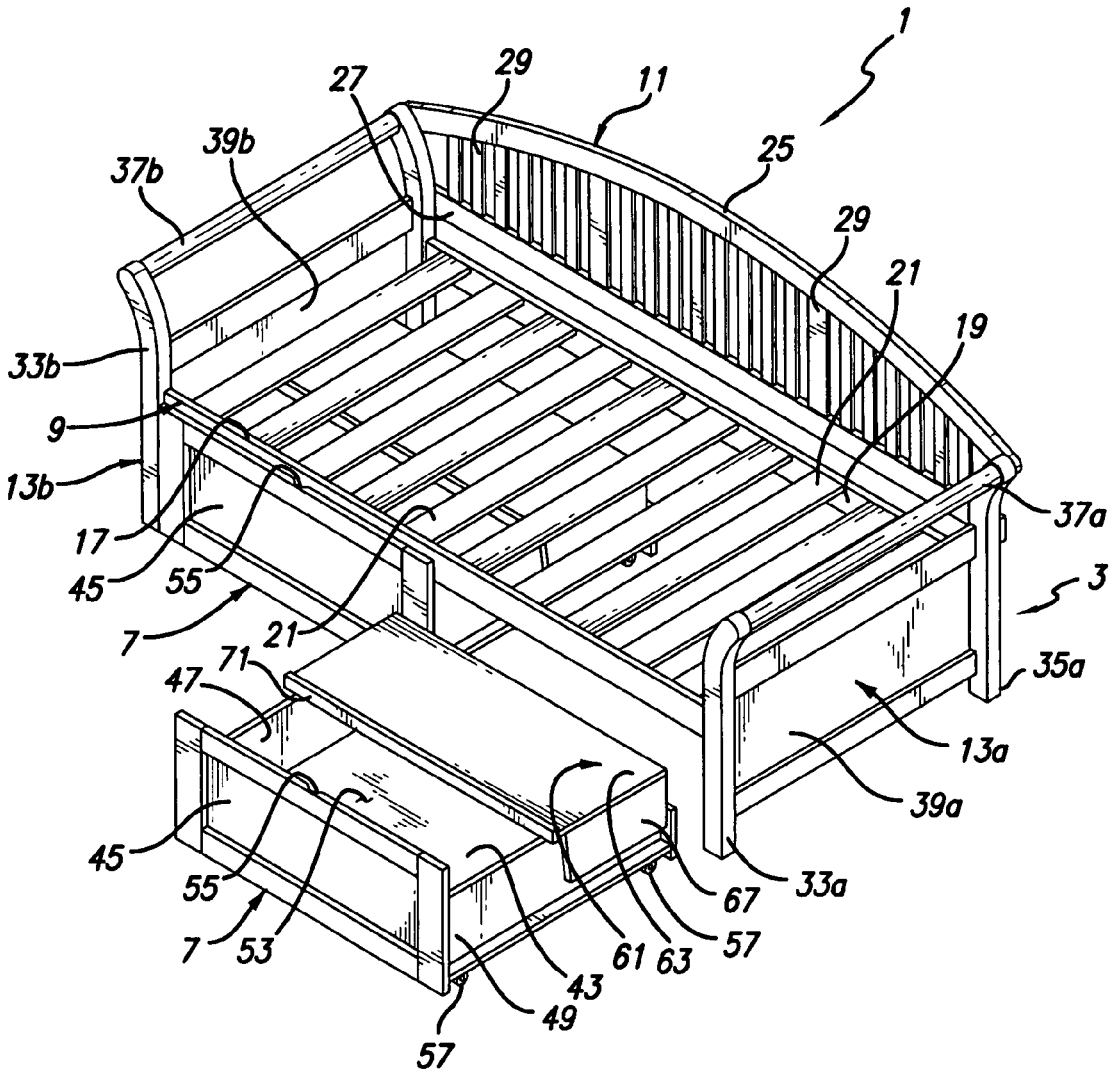
FIG. 5 is a perspective view similar to FIG. 1 with a storage container of the daybed moved forward of the daybed.
Figure 6:
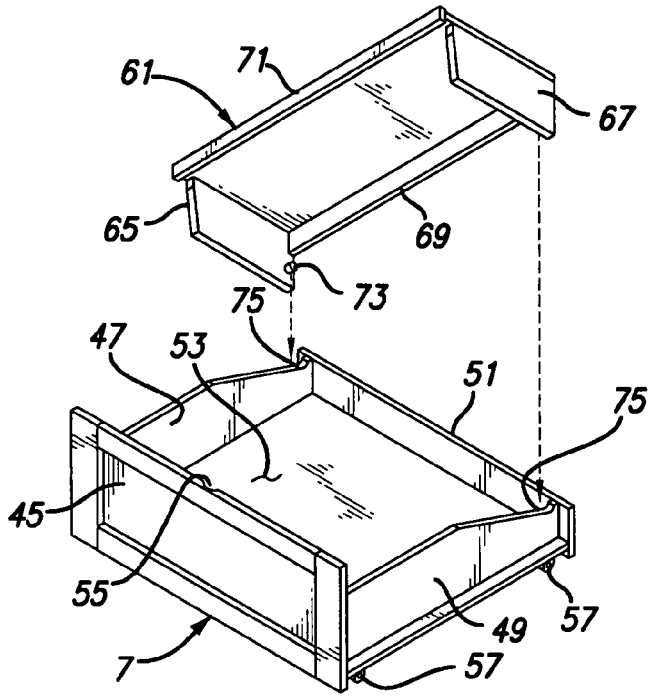
FIG. 6 is a perspective view of a storage container of the daybed of FIG. 1 with a cover of the storage container exploded generally above the container.
Figure 7:
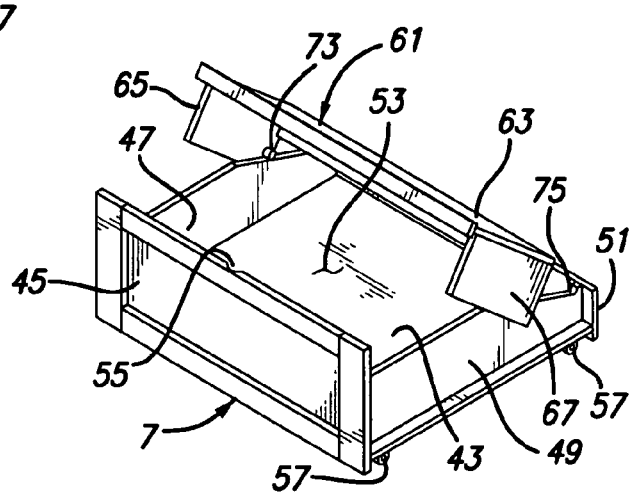
FIG. 7 is a perspective view of the storage container of FIG. 6 with the cover positioned partly on the storage container.

With reference now to FIGS. 5-8, the storage containers 7 of the illustrated daybed 1 will be described. Each storage container 7 may be generally rectangular in shape and generally may include a floor 43 and four sidewalls 45, 47, 49, 51 configured (e.g., formed, constructed, sized, shaped, etc.) to define an interior compartment 53 for storing/holding/retaining items in the container 7 (e.g., clothing, bedding, etc.). Together, the two storage containers 7 extend lengthwise along the daybed 1 substantially a length of the bed platform 9. The storage containers are configured to fit at least partly under the bed platform 9, for example when the daybed 1 is in the sitting configuration. A forward sidewall 45 of each storage container 7 may be generally taller than the other three side walls 47, 49, 51 so that, for example, when the container 7 is positioned at least partly under the bed platform 9, at least part of an upper portion of the forward sidewall 45 may be adjacent (and, for example, may abut against, etc.) the forward border rail 17 of the bed platform 9 (FIG. 5). The forward sidewall 45 of each storage container 7 also may include a recess 55 for allowing a user to grasp the storage container 7 for moving the storage container 7 relative to the daybed frame 3. In addition, rollers 57 are mounted to each storage container 7 under the floor 43 of each container for rolling the storage container 7 and helping improve container mobility. In other example embodiments, storage containers may include one or more handles to allow a user to grasp and move the storage containers.

Figure 8:
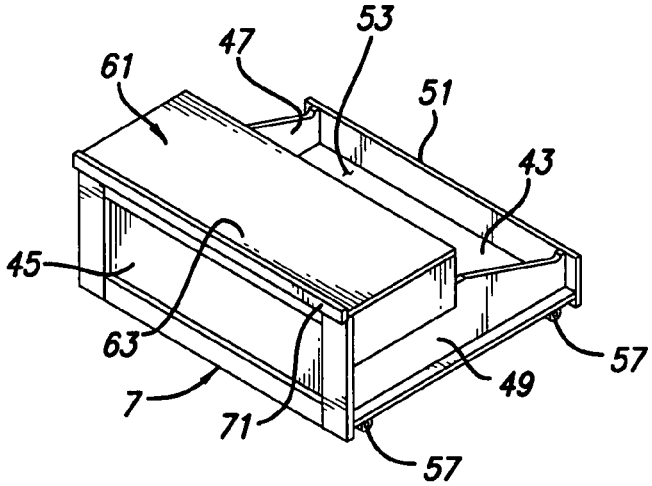
FIG. 8 is a perspective view of the storage container of FIG. 6 with the cover positioned on the storage container in a mattress supporting position.

The storage containers 7 each include a movable cover 61 configured to cover at least part of the storage container 7. The cover 61 generally may include an upper support surface 63, three sidewalls 65, 67, 69, and a forward lip 71. Mounting pins 73 are located on inward surfaces of left and right sidewalls 65, 67 of the containers 7 for positioning the cover 61 on the storage container 7 (e.g., FIGS. 6 and 7). In FIG. 5, the cover 61 is shown in a covering position at a rearward location of the storage container 7. Here, the mounting pins 73 are located in notches 75 in the left and right sidewalls 65, 67 of the storage container 7 to securely hold the cover 61 on the storage container 7. In FIG. 8, the cover 61 is shown moved to a mattress supporting position. Here, the mounting pins 73 rest on upper edges of the left and right sidewalls 65, 67 of the storage containers 7, and the forward lip 71 of the cover 61 fits over the forward sidewall 45 of the storage container 7 to securely hold the cover 61 in place.

Referring again to FIGS. 1 and 2, when the daybed 1 is in the sitting configuration the mattress 5 may be positioned substantially on/over the bed platform 9 and on/against the back panel 11 of the daybed 1. The storage containers 7 are located at least partly under the bed platform 9 generally within a footprint of the daybed 1 (as defined generally by a perimeter of the bed platform 9) with the covers 61 of the storage containers 7 in the covering position. At least part of an upper portion of the forward sidewall 45 of each storage container 7 may be positioned adjacent the forward border rail 17 of the bed platform 9. One or both of the storage containers 7 could be positioned, however, at a location other than under the bed platform 9 of the daybed 1, for example at a location away from the daybed 1, within the scope of the present disclosure.

Figure 3:
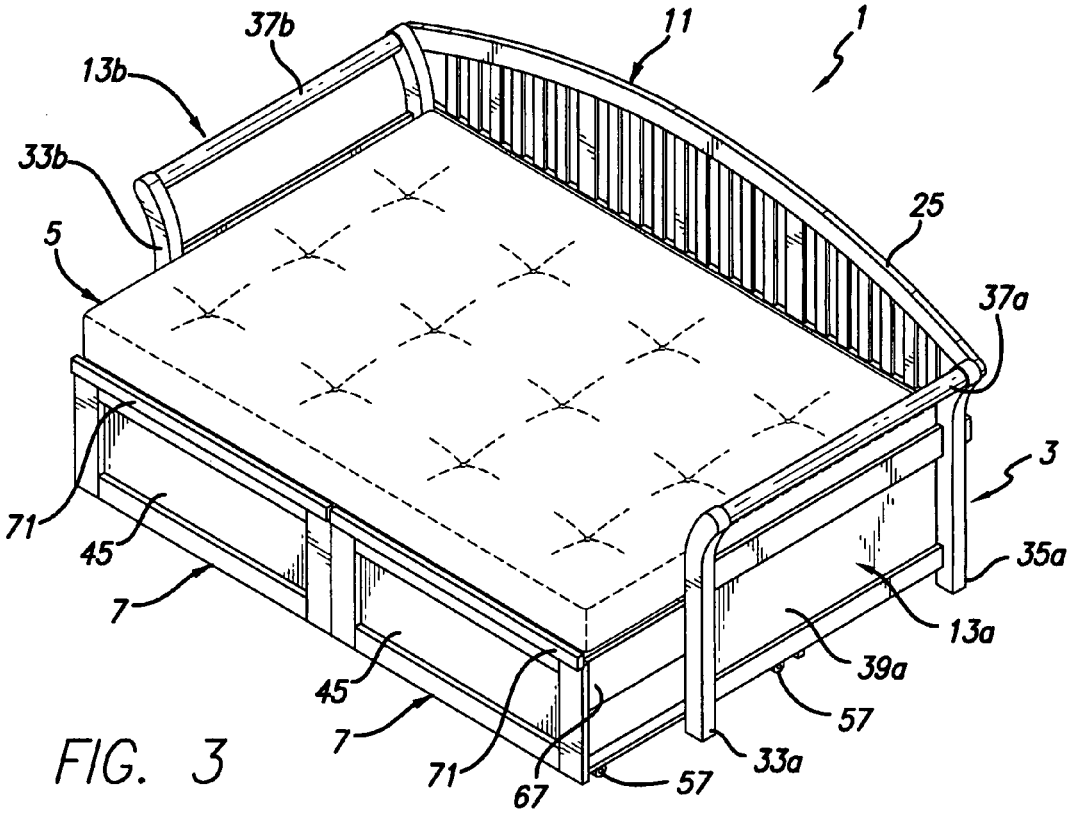
FIG. 3 is a perspective view similar to FIG. 1 with the daybed in a lying configuration.
Figure 4:
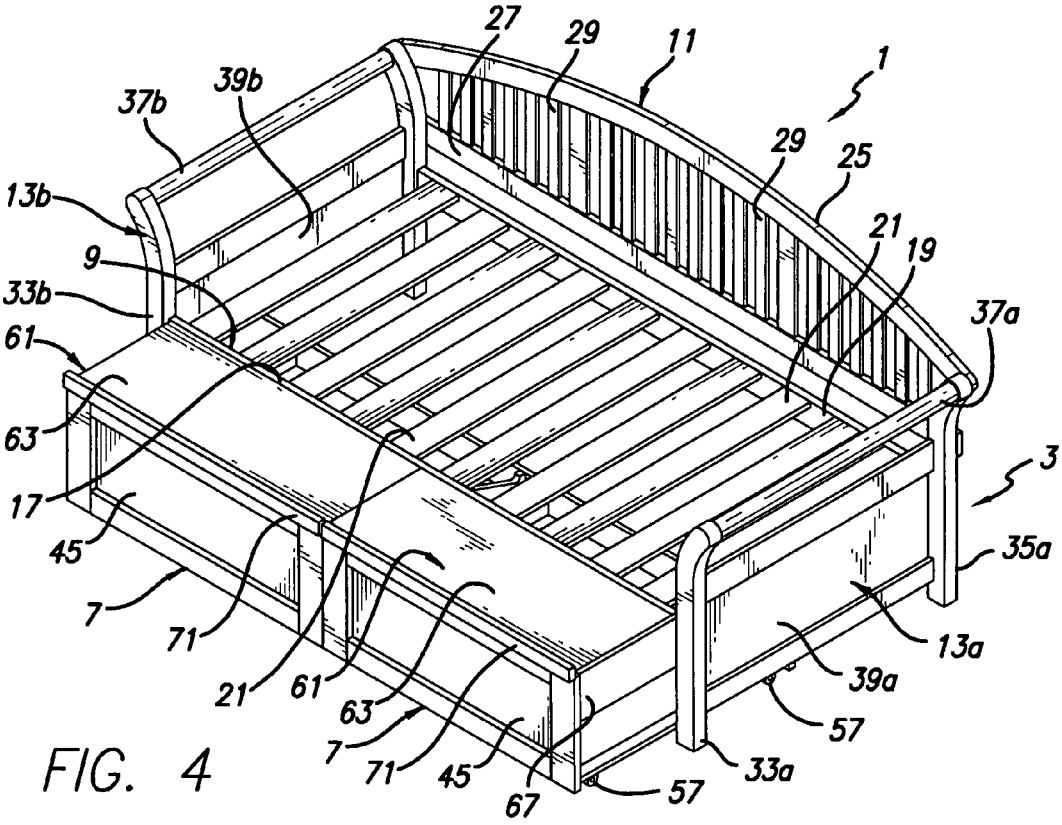
FIG. 4 is a perspective view similar to FIG. 3 with the mattress of the daybed removed.

To convert the daybed 1 to the lying configuration shown in FIGS. 3 and 4, the storage containers 7 may be moved (e.g., rolled on rollers, etc.) from under the bed platform 9 to a location forward of the daybed 1 (e.g., FIG. 5). The covers 61 of each storage container 7 may then be moved from the covering position to the mattress supporting position (see, e.g., FIGS. 7 and 8), and the storage containers 7 may be moved adjacent the forward border rail 17 of the bed platform 9 (FIG. 4). At least part of the rearward sidewall 69 of the cover 61 of each container 7 may abut against the forward border rail 17. In this configuration, the upper support surfaces 63 of the storage container covers 61 are each oriented in a generally common plane with the support surface of the bed platform 9 (as generally defined by the slats 21 thereof). The mattress 5 may now be moved (e.g., slid, etc.) in a forward direction so that at least part of the mattress 5 moves over the support surfaces 63 of the storage containers 7 and so that the part of the mattress 5 previously resting against the back panel 11 is now substantially located over the bed platform 9 (FIG. 3). Here, the bed platform 9 and storage containers 7 support the mattress 5 on the daybed 1. More particularly, the storage containers 7 support a part of the mattress 5 extending forward of the daybed 1 beyond the footprint of the daybed 1.

Conversion of the daybed 1 from the lying configuration back to the sitting configuration may be achieved by using this same operation in reverse. For example, the mattress 5 may be repositioned on the daybed 1 (and over the bed platform 9) by moving the mattress 5 in a rearward direction off the storage containers 7 and then positioning at least part of the mattress 5 against the back panel 11 of the daybed 1. The covers 61 of the storage containers 7 may be moved back to their covering positions, and the storage containers 7 may be moved back to positions at least partly under the bed platform 9.

Figure 9:
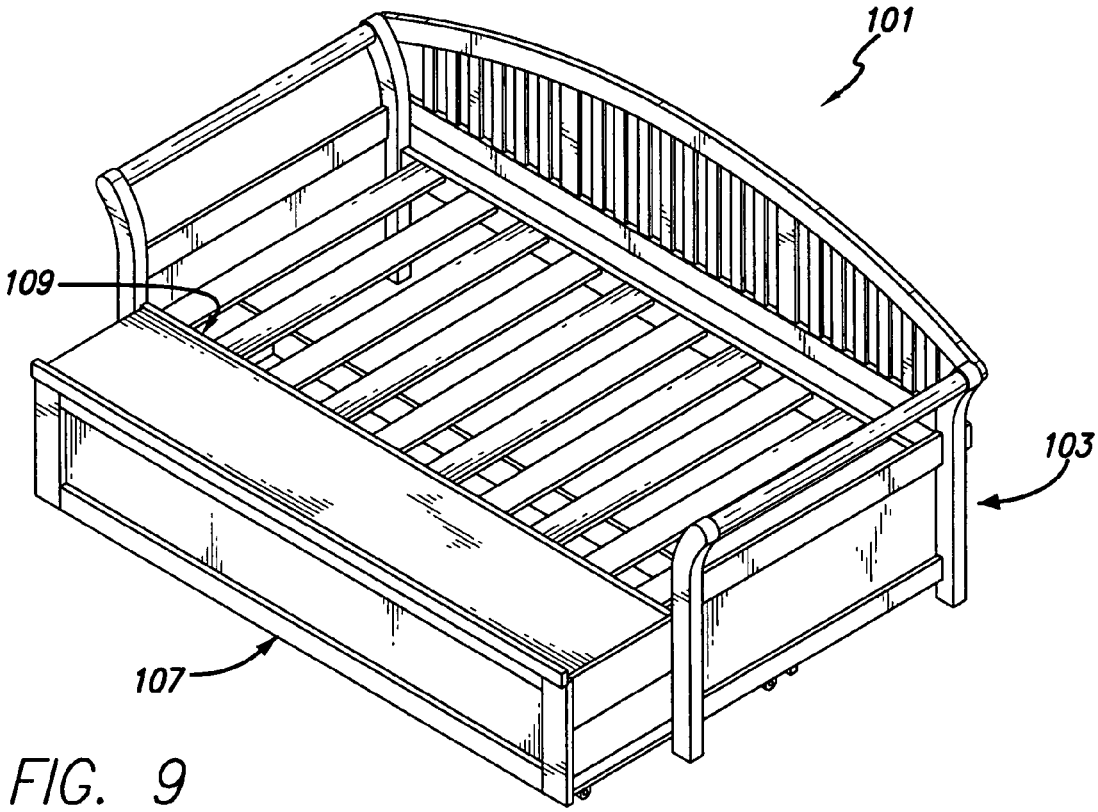
FIG. 9 is a perspective view of another example embodiment of a daybed with a mattress of the daybed removed and with the daybed in a lying configuration.
Figure 10:
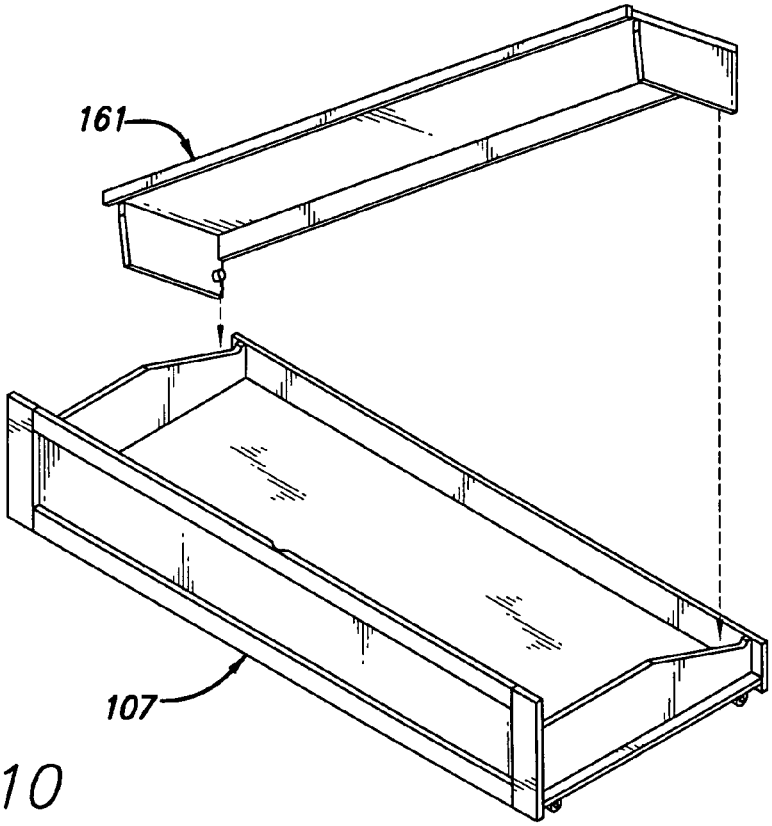
FIG. 10 is a perspective view of a storage container of the daybed of FIG. 9 with a cover of the storage container exploded generally above the container.

FIGS. 9 and 10 illustrate a frame 103 and storage container 107 (broadly, a "support member") of a daybed 101 according to another example embodiment. A mattress of the daybed 101 is not illustrated in the drawings. The daybed 101 of an example embodiment may be substantially similar to the daybed 1 previously described and illustrated in FIGS. 1-8, but may include only one storage container 107. Here, the one storage container 107 may include a cover 161 and extends lengthwise along the daybed substantially a length of a bed platform 109 of the daybed frame 103.

Figure 11:
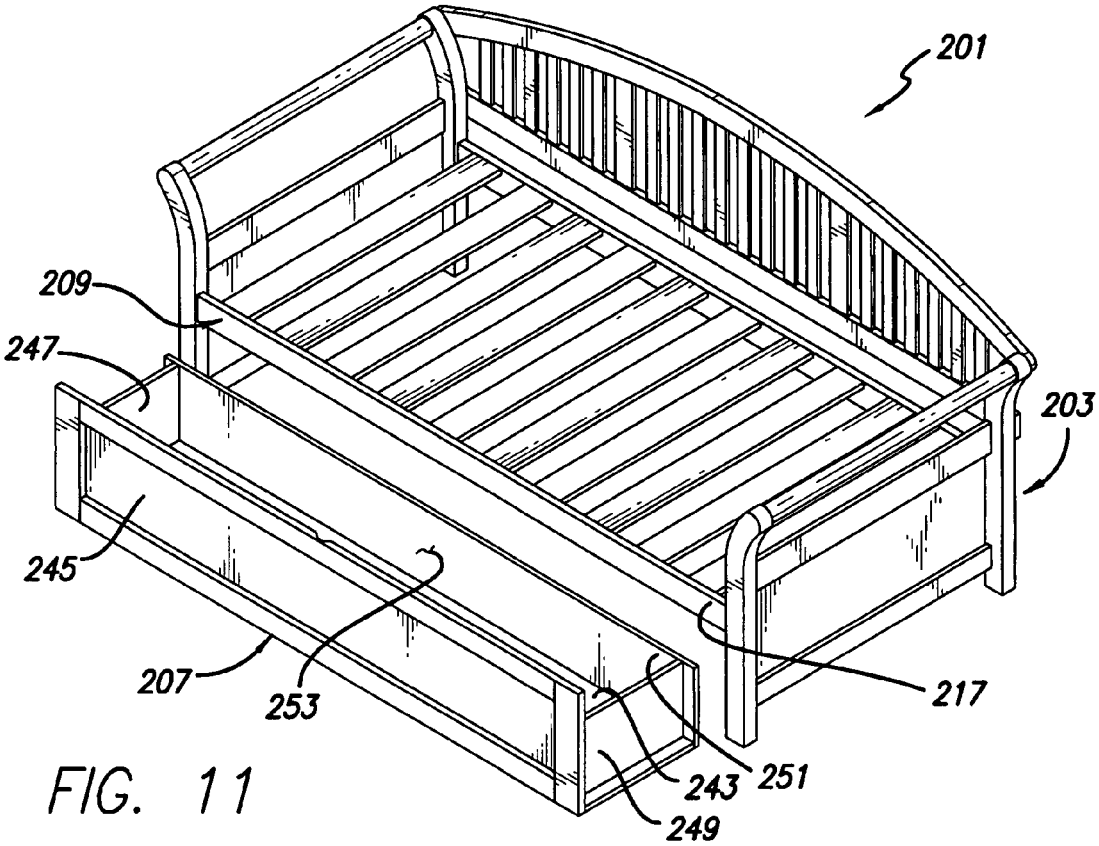
FIG. 11 is a perspective view of still another example embodiment of a daybed with a mattress of the daybed removed and with the daybed in a sitting configuration.
Figure 12:
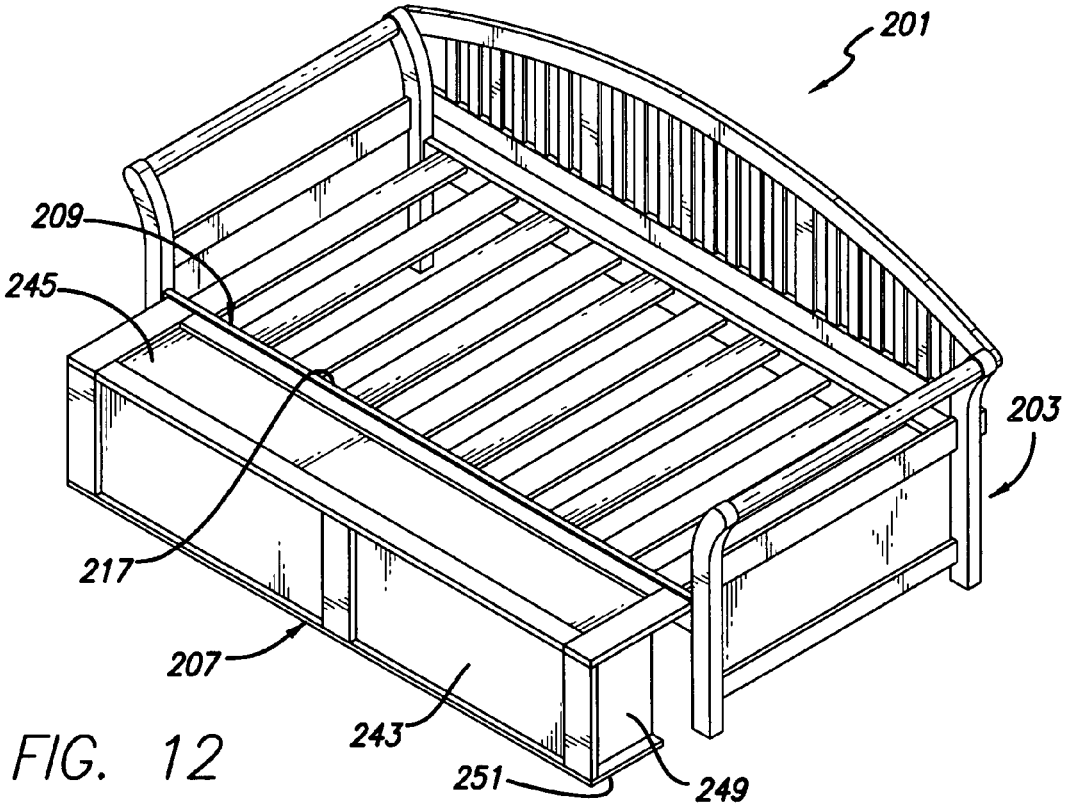
FIG. 12 is a perspective view of the daybed of FIG. 11 with the daybed in a lying configuration.

FIGS. 11 and 12 illustrate a frame 203 and storage container 207 (broadly, a "support member") of a daybed 201 according to still another example embodiment. Again, a mattress of the daybed 201 is not illustrated, and the frame 203 of the daybed 201 may be substantially similar to the frame 3 of the daybed 1 previously described and illustrated in FIGS. 1-8.

In an example embodiment, however, the daybed 201 may include only one storage container 207, which extends lengthwise along the daybed 201 substantially a length of a bed platform 209 of the daybed frame 203. The storage container 207 may be generally rectangular in shape and generally may include a floor 243 and four sidewalls 245, 247, 249, 251 configured to define an interior compartment 253 for storing/holding/retaining items in the container 207. The storage container 207 may be configured such that it may fit at least partly under the bed platform 209 of the daybed 201 when the daybed is in a sitting configuration. A forward sidewall 245 of the storage container 207 may be generally taller than the other three sidewalls 247, 249, 251 so that, for example, when the container 207 is positioned at least partly under the bed platform 209, at least part of an upper portion of the forward sidewall 245 may be adjacent (and, for example, may abut against, etc.) a forward border rail 217 of the bed platform 209. In an example embodiment, the floor 243 of the storage container 207 may be free of rollers such that the storage container 207 may be moved by, for example, sliding the storage container 207 over the floor.

When the daybed 201 of an example embodiment is in the sitting configuration (FIG. 11), the storage container 207 may be located at least partly under the bed platform 209 of the daybed 201. To convert the daybed 201 to a lying configuration (FIG. 12), the storage container 207 may be moved (e.g., slid, etc.) from under the bed platform 209 and rotated so that the forward side wall 245 of the container 207 faces generally upwardly. The storage container 207 may then be moved adjacent the forward border rail 217 of the bed platform 209 (FIG. 12). In this configuration, the forward sidewall 245 of the storage container 207 provides a support surface on which (together with a support surface of the bed platform 209) at least part of a mattress of the daybed 201 may be positioned and/or supported.

Figure 13:
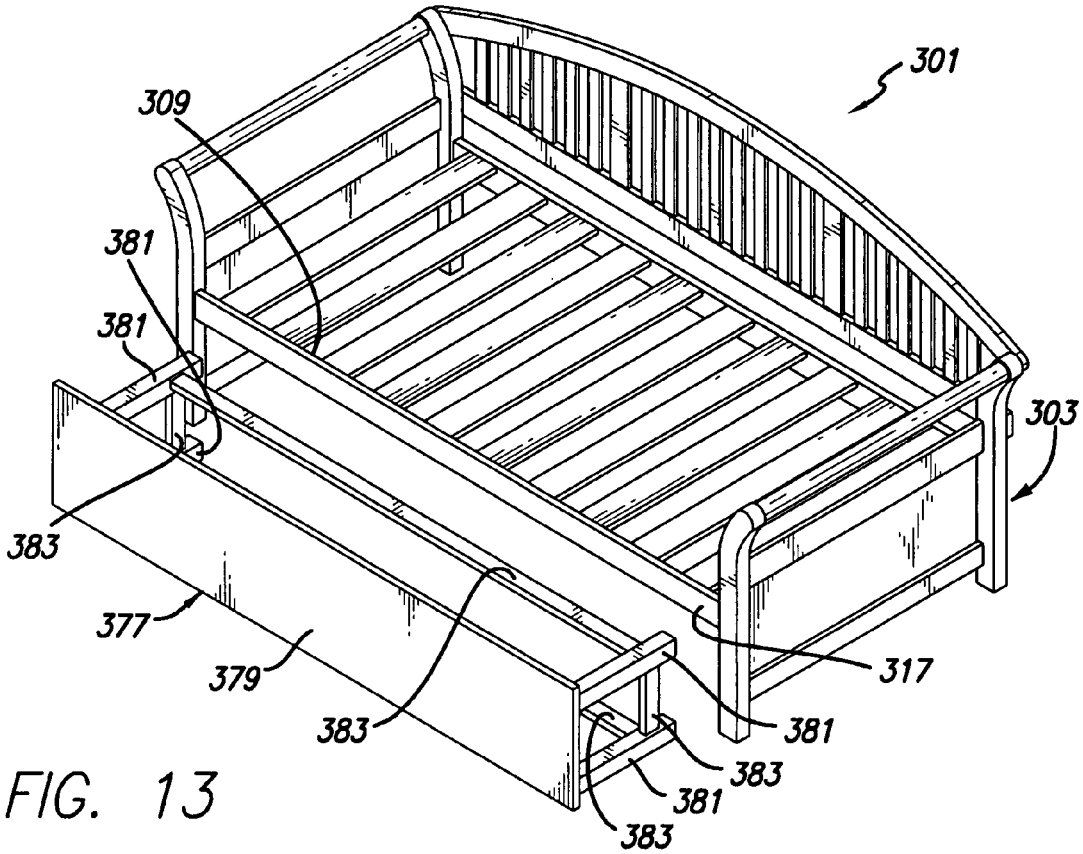
FIG. 13 is a perspective view of another example embodiment of a daybed with a mattress of the daybed removed and with the daybed in a sitting configuration.
Figure 14:
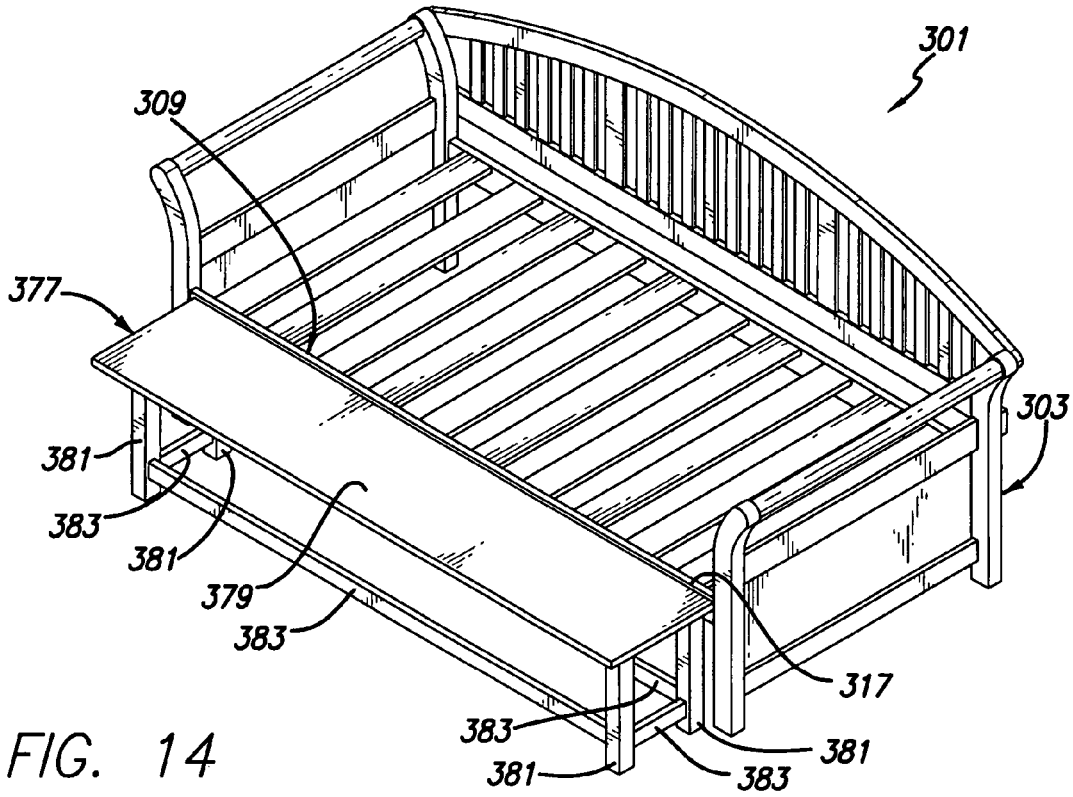
FIG. 14 is a perspective view of the daybed of FIG. 13 with the daybed in a lying configuration.

FIGS. 13 and 14 illustrate a frame 303 and support member, such as support bench 377, of a daybed 301 according to another example embodiment. A mattress of the daybed 301 is again not illustrated, and the frame 303 of the daybed 301 may be substantially similar to the frame 3 of the daybed 1 previously described and illustrated in FIGS. 1-8.

In an example embodiment, the support bench 377 may include an upper support surface 379, legs 381 on which the upper support surface 379 is mounted, and bracing members 383 between the legs 381 for strengthening and/or stabilizing the support bench 377. The support bench 377 may be configured such that it may fit at least partly under the bed platform 309 of the daybed 301 when the daybed is in a sitting configuration. For example, as shown in FIG. 13 the support bench 377 may be positioned on a side for placement at least partly under the bed platform 309. The support bench 377 may be positioned away from the frame 303 of the daybed 301 when the daybed is in the sitting configuration for use as, for example, an additional seat within the scope of the present disclosure.

When the daybed 301 of an example embodiment is in the sitting configuration (FIG. 13), the support bench 377 may be located at least partly under the bed platform 309. To convert the daybed 301 to a lying configuration (FIG. 14), the support bench 377 may be moved (e.g., slid, etc.) from under the bed platform 309 and rotated so that the support bench 377 rests on its legs 381 with the upper support surface 379 facing generally upwardly. The support bench 377 may then be moved adjacent a forward border rail 317 of the bed platform 309 (FIG. 14). In this configuration, the upper support surface 379 of the support bench 377 provides a support surface on which (together with a support surface of the bed platform 309) at least part of a mattress of the daybed 301 may be positioned and/or supported.

Figure 15:
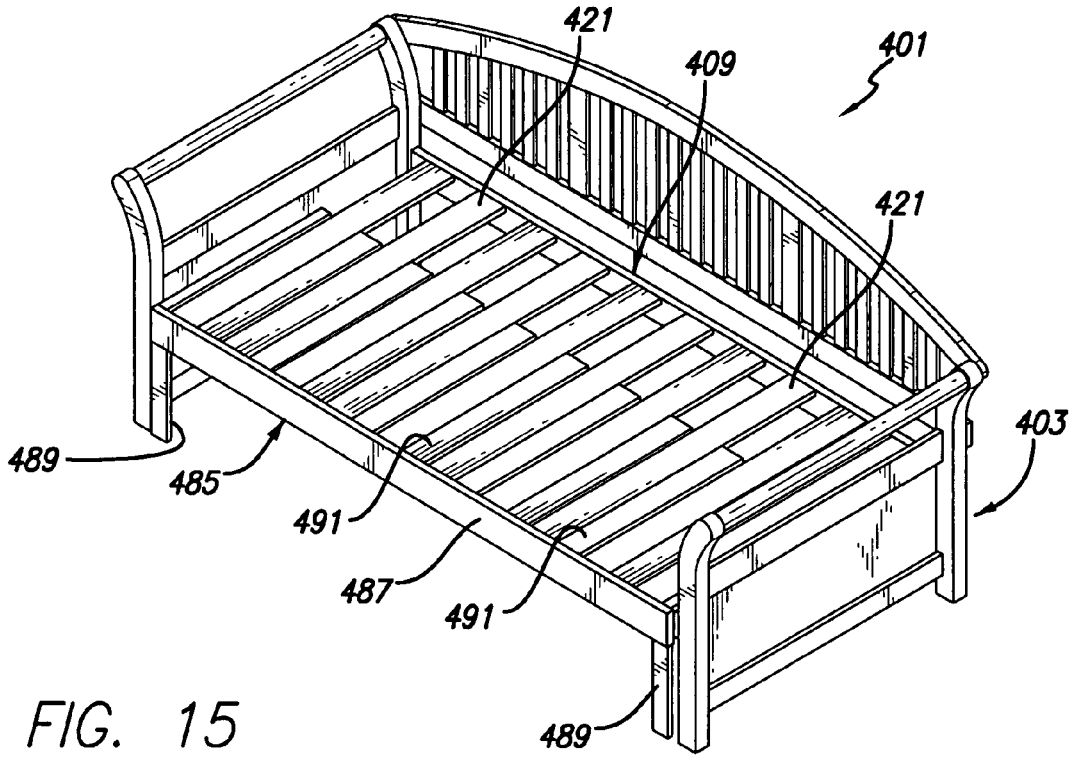
FIG. 15 is a perspective view of yet another example embodiment of a daybed with a mattress of the daybed removed and with the daybed in a sitting configuration.
Figure 16:
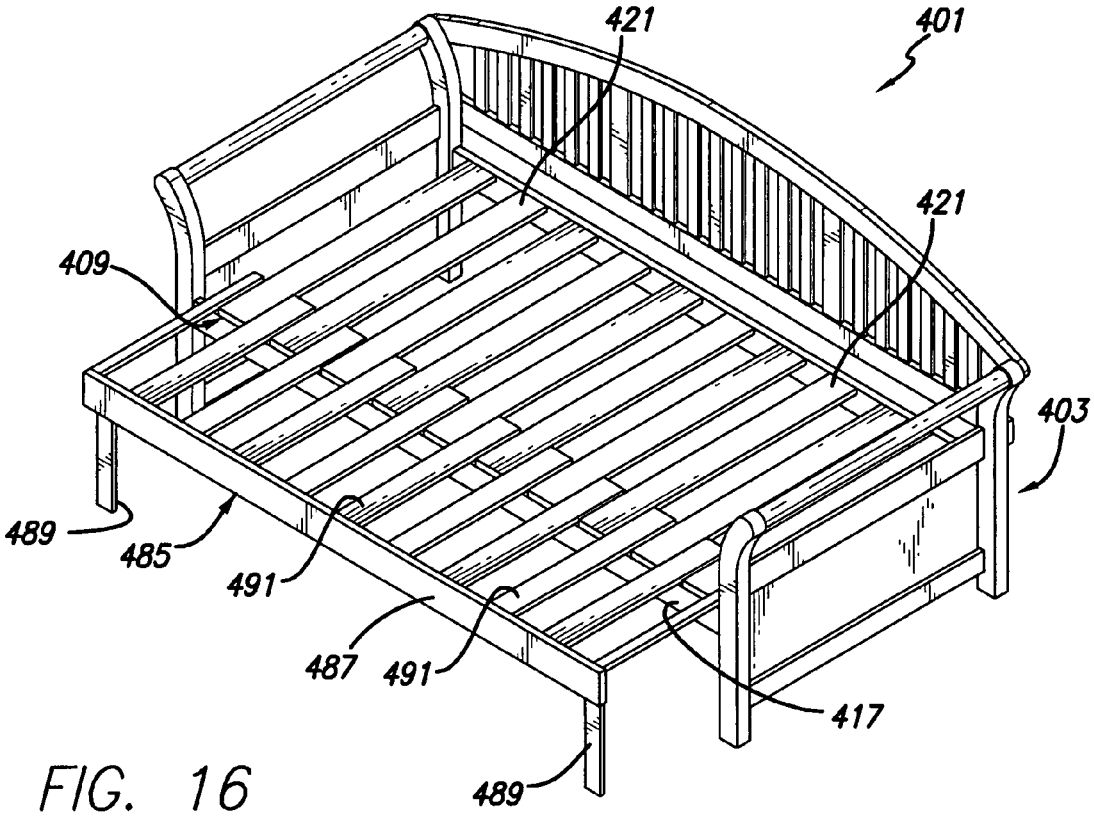
FIG. 16 is a perspective view of the daybed of FIG. 15 with the daybed in a lying configuration.

FIGS. 15 and 16 illustrate a frame 403 and support member, such as extension platform 485, of a daybed 401 according to another example embodiment. A mattress of the daybed 401 is not illustrated in the drawings, and the frame 403 of the daybed 401 may be substantially similar to the frame 3 of the daybed 1 previously described and illustrated in FIGS. 1-8.

In an example embodiment, the extension platform 485 may include a forward support rail 487, a pair of legs 489 on which the support rail 487 is mounted, and multiple support slats 491 extending away from the rail 487. The support slats 491 each have similar lengths and extend in a generally parallel orientation away from the support rail 487 with each slat 491 spaced about a uniform distance from an adjacent slat 491. A width of each support slat 491 closely matches a spacing between adjacent slats 421 of a bed platform 409 of the daybed 401, and the spacing between adjacent support slats 491 closely matches a width of each slat 421 of the bed platform 409. This allows the support slats 491 of the extension platform 485 to position in the spaces between the slats 421 of the bed platform 409 and operatively connects the extension platform 485 and the bed platform 409.

When the daybed 401 of an example embodiment is in a sitting configuration (FIG. 15), the support slats 491 of the extension platform 485 may be retracted within the daybed 401 and the forward support rail 487 may be adjacent (e.g., may abut against, etc.) the forward border rail 417 of the bed platform 409 (FIG. 15). To convert the daybed 401 to a lying configuration (FIG. 16), the extension platform 485 may be moved (e.g., extended, slid, etc.) forward from the bed platform 409 so that at least a free end portion of each of the support slats 491 remains generally within the daybed 401 on the forward border rail 417 of the bed platform 409. Here, the legs 489 of the extension platform 485 and the forward border rail 417 of the bed platform 409 help hold/support the support slats 491 above the floor. In this configuration, the support slats 491 define a support surface on which (together with a support surface of the bed platform 409) at least part of a mattress of the daybed 401 may be positioned and/or supported.

In an example embodiment, the bed platform 409 and extension platform 485 both include spaced-apart slats 421, 491 defining support surfaces on which at least part of a mattress of the daybed 401 may be positioned and/or supported. It is contemplated, however, that one or more of the bed platform 409 and extension platform 485 may include solid support surfaces not including spaced apart slats (e.g., defined by sheets of plywood, etc.). Here, for example, the support surface of the extension platform 485 may be positioned over, or on top of, the support surface of the bed platform 409. And when moving the daybed 401 between the sitting configuration and the lying configuration, the support surface of the extension platform 485 may slide over the support surface of the bed platform 409.

Figure 17:
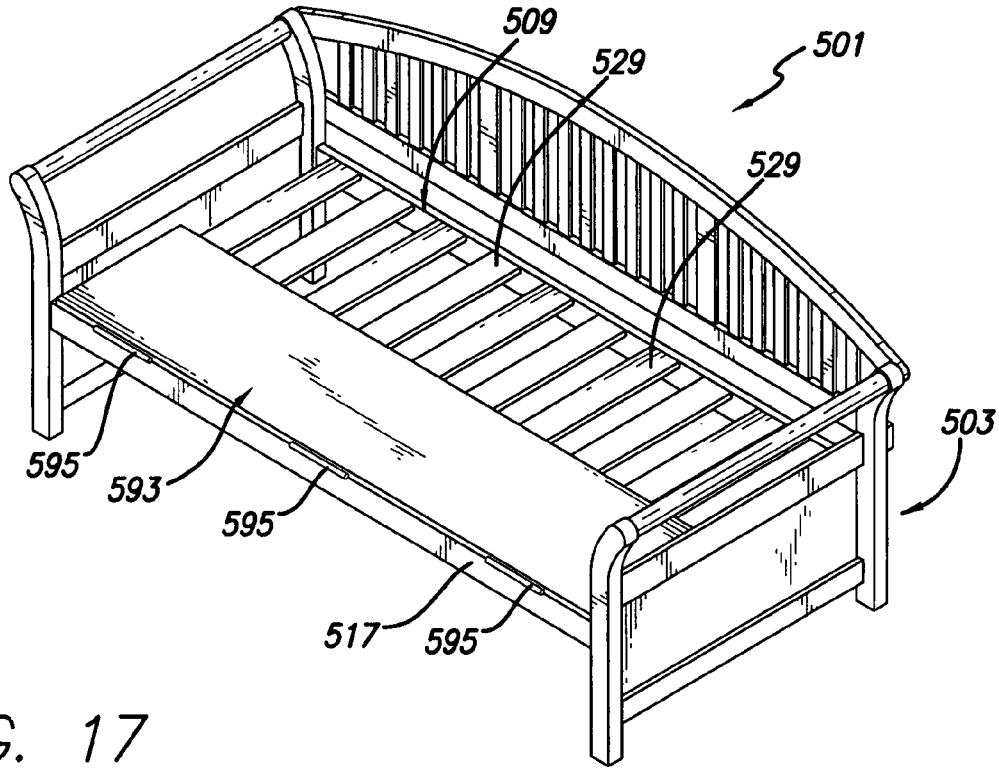
FIG. 17 is a perspective view of another example embodiment of a daybed with a mattress of the daybed removed and with the daybed in a sitting configuration.
Figure 18:
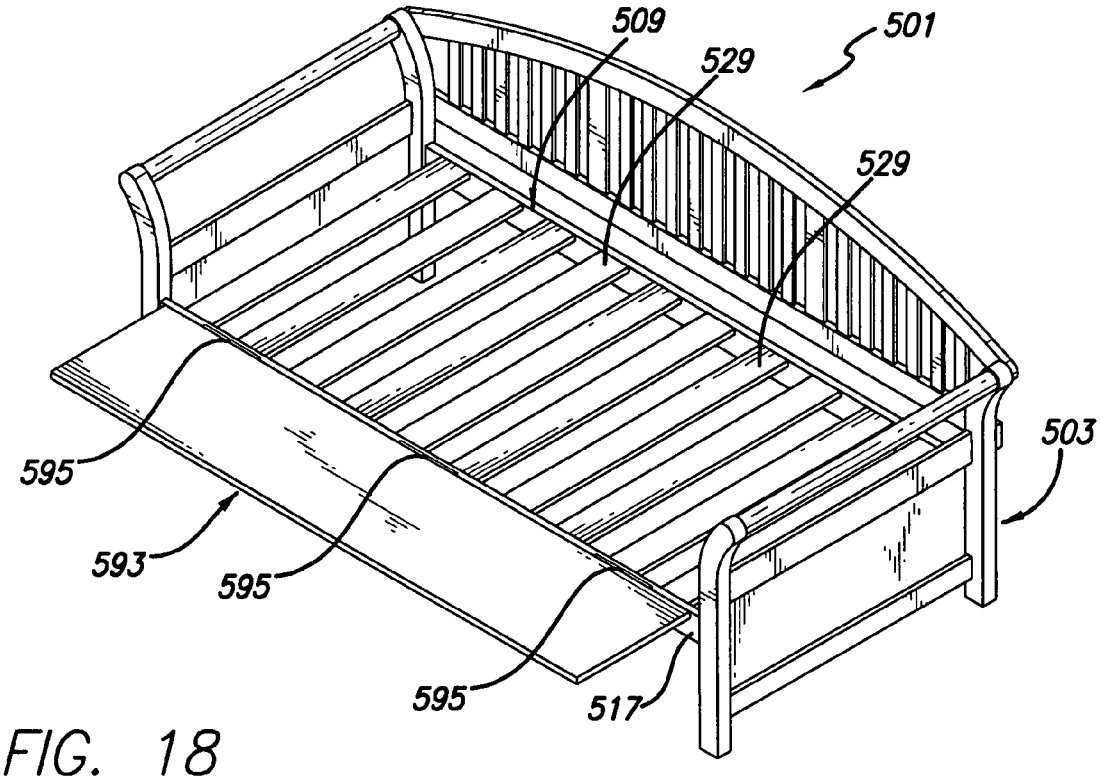
FIG. 18 is a perspective view of the daybed of FIG. 17 with the daybed in a lying configuration.

FIGS. 17 and 18 illustrate a frame 503 and support member, such as platform 593, of a daybed 501 according to another example embodiment. Again, a mattress of the daybed 501 is not illustrated, and the frame 503 of the daybed 501 may be substantially similar to the frame 3 of the daybed 1 previously described and illustrated in FIGS. 1-8.

In an example embodiment, the platform 593 may be pivotally connected (e.g., operatively connected) to a forward border rail 517 of a bed platform 509 of the daybed 501 (e.g., by hinges 595). When the daybed 501 is in a sitting configuration (FIG. 17), the platform 593 may be positioned (e.g., retracted, etc.) generally above (e.g., on top of, etc.) the slats 529 of the bed platform 509 within a footprint of the daybed 501. However, the platform 593 may be positioned generally under the slats 529 of the bed platform 509 within the scope of the present disclosure. To convert the daybed 501 to a lying configuration (FIG. 18), the platform 593 may be pivoted (e.g., rotated, extended, etc.) forwardly from the bed platform 509. The hinges 595 may be configured to allow the extended platform 593 to pivot only about one-hundred eighty degrees such that the hinges 595 support the platform 593 in position above the floor as shown in FIG. 18 in a generally common plane with a support surface of the bed platform 509. In this configuration, the platform 593 provides a support surface on which (together with a support surface of the bed platform 509) at least part of a mattress of the daybed 501 may be positioned and/or supported.

While in an example embodiment the hinges 595 may provide support and/or stability to the extended platform 593, in other example embodiments platforms may be connected to bed platforms of daybeds other than by hinges. For example, the platforms may be slidably connected to the bed platforms by rails. In addition, in other example embodiments additional and/or alternative structures may be provided to at least partly provide support and/or stability to extended platforms on which at least part of mattresses of daybeds may be positioned and/or supported.

Figure 19:
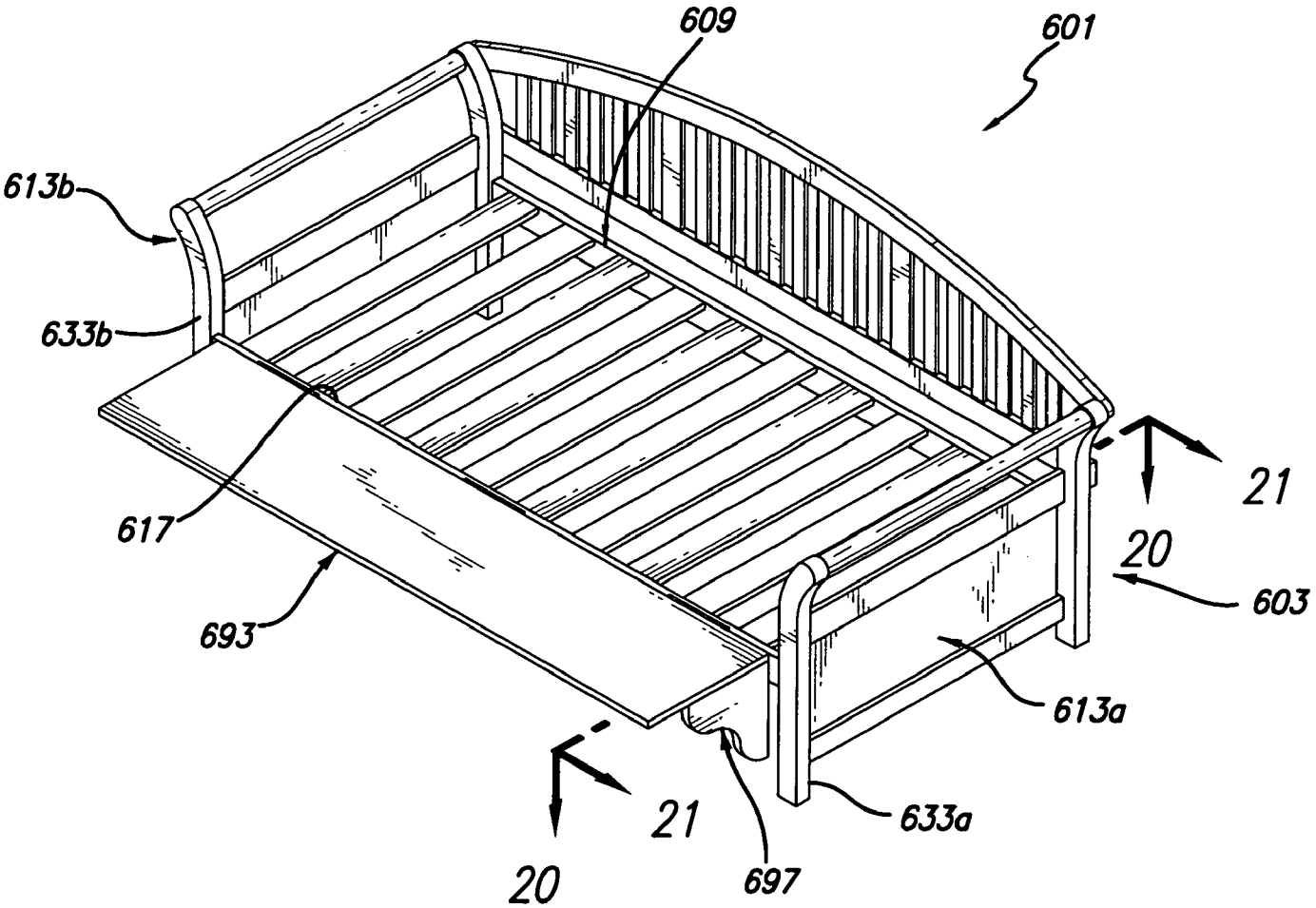
FIG. 19 is a perspective view of yet another example embodiment of a daybed with a mattress of the daybed removed and with the daybed in a lying configuration.
Figure 20:
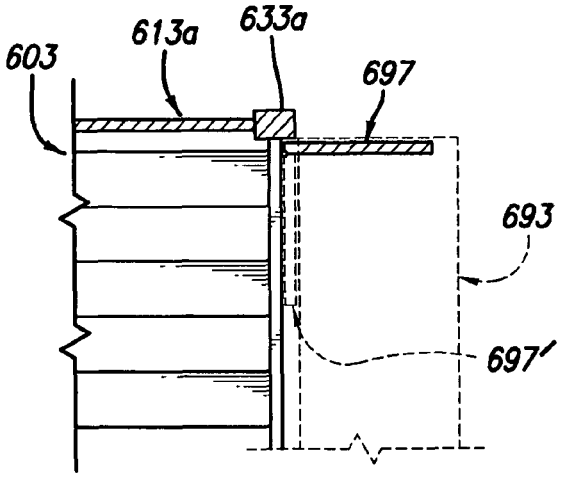
FIG. 20 is a section view of part of the daybed of FIG. 19 taken in a plane including line 20-20 in FIG. 19 and illustrating a support bracket of the daybed.
Figure 21:
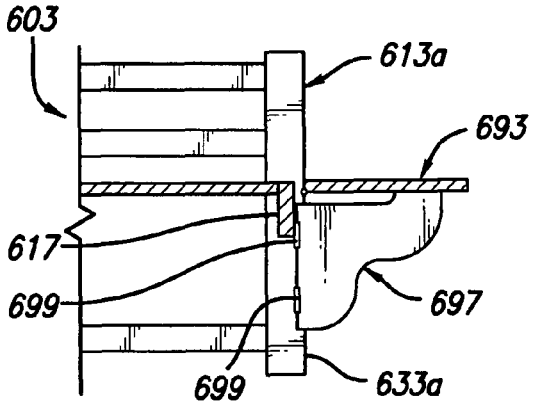
FIG. 21 is a section view of part of the daybed of FIG. 19 taken in a plane including line 21-21 in FIG. 19 and further illustrating the support bracket.

For example, FIGS. 19-21 illustrate a frame 603 and support member, such as platform 693, of a daybed 601 according to yet another example embodiment. The frame 603 and platform 693 of the daybed 601 are substantially similar to the frame 503 and platform 593 of the daybed 501 previously described and illustrated in FIGS. 17 and 18. But in an example embodiment, support brackets 697 provide additional support to the extended platform 693 when the daybed is in a lying configuration (FIG. 19) (only one bracket 697 may be visible in the drawings).

As shown in FIG. 19, the support brackets 697 pivotally connect to legs 633*a*, 633*b* of arm panels 613*a*, 613*b* of the daybed 601. The support bracket 697 connected to leg 633*a* will now be described with it understood that a description of the other support bracket 697 connected to leg 633*b* may be substantially the same. As shown in FIGS. 20 and 21, the support bracket 697 may be connected to the leg 633*b* by, for example, hinges 699. When the daybed 601 is in a sitting configuration, the support bracket 697 may be pivoted inwardly to a position adjacent a forward border rail 617 of a bed platform 609 of the daybed 601. In FIG. 20, the support bracket is shown in this position at 697' with broken lines. In addition, an outline of the platform 693 is shown in broken lines to illustrate relative orientation of the features. When the daybed is converted to the lying configuration, the support brackets 697 may be pivoted (e.g., rotated, etc.) outwardly about ninety degrees into position to support the platform 693.

Figure 22:
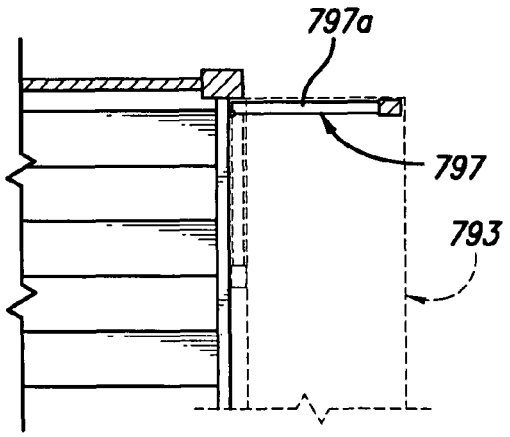
FIG. 22 is a section view similar to FIG. 20 of an alternative example embodiment of a support bracket of a daybed.
Figure 23:
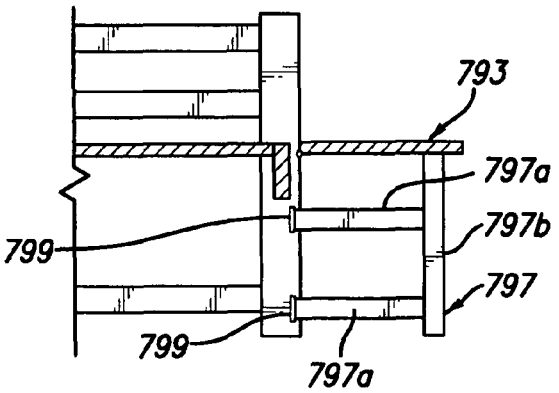
FIG. 23 is a section view similar to FIG. 21 further illustrating the alternative example support bracket of FIG. 22.

FIGS. 22 and 23 illustrate a support bracket 797 according to an alternative example embodiment for supporting an extended platform 793 of a daybed when the daybed is in a lying configuration. The extended platform 793 and support bracket 797 of an example embodiment are substantially similar to the extended platform 693 and support bracket 697 previously described and illustrated in FIGS. 19-21. But here, the support bracket 797 may include a pair of pivot arms 797*a* connected to a leg 733*a* of an arm panel 713*a* of the daybed (e.g., by hinges 799) and a support body 797*b* mounted on the pivot arms 797*a*.

Although example embodiments are directed to daybeds including numerous features and variations, example embodiments are not to be limited to the specific combinations of features and variations disclosed herein. The principles and features of the disclosed embodiments may be employed in varied and numerous embodiments without departing from the scope of the invention, as defined by the appended claims. For example, similar daybed frame shapes/styles have been described and illustrated through the embodiments of the present disclosure. However, these daybed frame shapes/styles are not intended to limit the scope of the present disclosure. It is to be understood different daybed frame shapes/styles may be used. For example, daybed frames may include bed platforms and/or back decks comprising sheets of material (e.g., plywood, etc.) instead of slats; daybed frames may include bed platforms and/or back decks and/or arm panels shaped differently than illustrated herein; etc.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof. As used herein, the term "and/or" includes any and all combinations of one or more of the associated listed items.

It will be understood that, although the terms first, second, third etc. may be used herein to describe various elements, components, regions, portions, and/or sections, these elements, components, regions, portions, and/or sections should not be limited by these terms. These terms are only used to distinguish one element, component, region, portion, or section from another element, component, region, portion, or section. Thus, a first element, component, region, portion, or section discussed below could be termed a second element, component, region, portion, or section without departing from the scope of the example embodiments.

Certain terminology is used herein for purposes of reference only, and thus is not intended to be limiting. For example, terms such as "upper," "lower," "above," "below," "top," "bottom," "upward," "downward," "upwardly," "downwardly," "forward," "rearward," and the like refer to directions in the drawings to which reference is made. Terms such as "front," "back," "rear," "bottom," "side," and the like describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first," "second," and other such numerical terms referring to structures do not imply a sequence or order unless clearly indicated by the context.

The description of the disclosure is merely example in nature and, thus, variations that do not depart from the gist of the disclosure are intended to be within the scope of the disclosure. Such variations are not to be regarded as a departure from the spirit and scope of the disclosure.

What is claimed is:

1. A daybed convertible between a first configuration suitable for use as a sofa, and a second configuration suitable for use as a bed, the daybed comprising:

a frame including a bed platform having a first upper support surface on which at least part of a mattress is positioned when the daybed is in the second configuration;

a support member movable relative to the frame, the support member including a second upper support surface on which at least part of the mattress is positioned when the daybed is in the second configuration and which is oriented in a generally common plane with the first upper support surface when the daybed is in the second configuration, wherein the second upper support surface is at least partly under a part of the first upper support surface when the daybed is in the first configuration; and a storage container under the bed platform, the storage container having a first end facing a front end of the frame and a second end facing a back end of the frame, the storage container being movable relative to the frame, wherein the support member is configured to fit on the storage container and configured to be movable relative to the storage container, the second upper support surface being at a first elevation when the support member is supported near the first end of the storage container and at a second elevation that is lower than the first elevation when the support member is supported near the second end of the storage container.

2. The daybed of claim 1, wherein the frame includes a back panel connected to the bed platform, at least part of the mattress being positioned generally against the back panel when the daybed is in the first configuration.

3. The daybed of claim 1, wherein the support member is configured for positioning at least partly under the bed platform when the daybed is in the first configuration.

4. The daybed of claim 1, wherein the storage container includes one or more rollers for rolling the storage container relative to the frame of the daybed.

5. The daybed of claim 1, comprising two or more support members.

6. The daybed of claim 1, wherein the first upper support surface is coplanar in the first configuration.

7. The daybed of claim 1, wherein the support member is configured to fit entirely under the bed platform when the daybed is in the first configuration.

8. A support member for use with a daybed convertible between a first configuration suitable for use as a sofa, and a second configuration suitable for use as a bed, the support member comprising:

an upper support surface configured for orientation in a generally common plane with a corresponding upper support surface of a bed platform of the daybed when the daybed is in the second configuration, the upper support surface of the support member being further configured for placement under the corresponding upper support surface of the bed platform when the daybed is in the first configuration, wherein the upper support surface of the support member is configured to fit on a storage container and configured to be translationally and rotationally movable relative to the storage container, the storage container having a first end and a second end so that when the upper support surface of the support member is supported on the first end the upper support surface of the support member is at a first elevation and when the upper support surface of the support member is supported on the second end the upper support surface of the support member is at a second elevation which is different than the first elevation.

9. The support member of claim 8, wherein the support member is configured for being positioned at least partly under the bed platform of the daybed when the daybed is in the first configuration.

10. The support member of claim 8, in combination with the daybed, the daybed comprising the bed platform, a back panel, and arm panels connecting the bed platform and back panel.

11. The support member of claim 8, wherein the first upper support surface is coplanar in the first configuration.

12. The support member of claim 8, wherein the upper support surface of the support member is configured to fit entirely under the bed platform when the daybed is in the second configuration.

13. A method for converting a daybed between a first configuration suitable for use as a sofa and a second configuration suitable for use as a bed, the method comprising:

converting the daybed from the first configuration to the second configuration, including:

moving a support member having an upper support surface from underneath an upper support surface of a bed platform of the daybed such that the upper support surface of the support member is oriented in a generally common plane with the upper support surface of the bed platform of the daybed;

positioning a mattress over at least part of the upper support surface of the bed platform and over at least part of the upper support surface of the support member, wherein moving the support member having the upper support surface includes moving the support member having the upper support surface from a back end of a storage container to a front end of the storage container such that the movable support member changes elevation when the support member is moved from the back end of the storage container to the front end of the storage container.

14. The method of claim 13, wherein moving the support member when converting the daybed from the first configuration to the second configuration further comprises moving the support member from a position at least partly under the bed platform of the daybed.

15. The method of claim 13, further comprising:

converting the daybed from the second configuration to the first configuration, wherein converting the daybed from the second configuration to the first configuration includes repositioning the mattress over at least part of the bed platform and against at least part of a back panel of the daybed.

16. The method of claim 13, wherein the first upper support surface is coplanar in the first configuration.

17. The method of claim 13, further comprising:

moving the storage container relative to the frame.

18. The method of claim 17, wherein the storage container and the support member are simultaneously moved as the storage container is moved relative to the frame.

19. The method of claim 13, wherein moving the storage container precedes moving the support member having the upper support surface from the back end of the storage container to the front end of the storage container.

20. A daybed convertible between a first configuration suitable for use as a sofa, and a second configuration suitable for use as a bed, the daybed comprising:

a frame;

a mattress positioned at least partly on the frame;

a support member movable relative to the frame, the mattress being positioned at least partly on the support member when the daybed is in the second configuration, and a storage container under the bed platform, wherein the storage container includes a first end and a second end, and the movable support member being configured to move between the first end and the second end, the storage container being configured so that the movable support member changes elevation as the movable support member is moved from the first end to the second end so that a top surface of the movable support member and an upper support surface of the bed platform generally lie in a common plane when the movable support member is moved to the second end.

21. The daybed of claim 20, wherein the storage container includes a side wall with a horizontal portion and an inclined portion and the movable support member is configured to move along the inclined portion when the movable support member is moved from the first end to the second end.

* * * * *